US006347204B1

(12) United States Patent
Kurosawa

(10) Patent No.: US 6,347,204 B1
(45) Date of Patent: Feb. 12, 2002

(54) TONER CARTRIDGE WITH DETACHABLE PHOTOSENSITIVE MEMBER AND IMAGE FORMING APPARATUS USING THE TONER CARTRIDGE

(75) Inventor: Eiji Kurosawa, Ueda (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/678,831

(22) Filed: Oct. 4, 2000

(30) Foreign Application Priority Data

Mar. 1, 2000 (JP) ..... 12-056276

(51) Int. Cl.[7] ..... G03G 15/00; G03G 21/16

(52) U.S. Cl. ..... 399/113; 399/117

(58) Field of Search ..... 399/111, 113, 399/114, 117

(56) References Cited

U.S. PATENT DOCUMENTS 5,160,963 A * 11/1992 Haneda et al. ..... 399/113
5,331,373 A * 7/1994 Nomura et al. ..... 399/111

FOREIGN PATENT DOCUMENTS

JP 6-12005 1/1994
JP 10-31405 2/1998

* cited by examiner

*Primary Examiner*—Joan Pendegrass
(74) *Attorney, Agent, or Firm*—Greenblum & Bernstein, P.L.C.

(57) ABSTRACT

A toner cartridge 107 of the present invention comprises a cartridge main body 106 having a toner storing section 114 for storing toner, a photosensitive member 109 for forming a toner image with the toner, and a rotation unit 105, which is rotatably held by the cartridge main body 106 in a state that the photosensitive member 109 is rotatably maintained, for rotating the photosensitive member 109 to a detachable position.

12 Claims, 6 Drawing Sheets

TONER CARTRIDGE WITH DETACHABLE PHOTOSENSITIVE MEMBER AND IMAGE FORMING APPARATUS USING THE TONER CARTRIDGE

BACKGROUND OF THE INVENTION

1. Field of the Invention

The present invention relates to a unitary toner cartridge in which parts such as a photosensitive member and the like used for development, and an image forming apparatus using the same are stored.

2. Description of the Related Art

Conventionally, in this type of image forming apparatus, parts such as a toner storing section used to form an image, a developing roller, a photosensitive member, a charging section and the like are stored in a unitary toner cartridge to be exchangeable. Then, when toner in the toner storing section of the toner cartridge is used up, a new cartridge is attached to use. Moreover, when the lifetime of the part such as photosensitive member expires, a new cartridge is attached to use. In this type of toner cartridge, one photosensitive member is combined as a unit. Moreover, the toner cartridge has such a configuration that makes it impossible to touch the photosensitive member externally in order to protect the surface of the photosensitive member.

However, in the conventional configuration in which the photosensitive member is combined with the toner cartridge as a unit, since the photosensitive member is designed not to be detached from the toner cartridge, there is a possibility that the photosensitive member will be damaged if the replacement of the photosensitive member is forcefully carried out. Furthermore, when the lifetime of the photosensitive member expires, the entire toner cartridge including the photosensitive member needs the replacement even though the other parts are usable.

Although there is the toner cartridge having a configuration in which the photosensitive member can be detached, this toner cartridge has a configuration in which the photosensitive member cannot be touched externally. For this reason, in order to execute the detachment of photosensitive member, the photosensitive member must be detached after removing the parts covering the photosensitive member. Moreover, an attaching structure is extremely complicated, for example, an attaching member for photosensitive member is covered with other member. Therefore, a person, who is familiar with the toner cartridge, must execute the detachment of photosensitive member. Namely, the general user cannot detach the photosensitive member.

SUMMARY OF THE INVENTION

It is an object of the present invention to provide a toner cartridge wherein a photosensitive member can be easily detached to execute the replacement without difficulty, reducing an economical burden on the user.

The toner cartridge of the present invention comprises a cartridge main body having a toner storing section for storing toner, a photosensitive member for forming a toner image using toner, and a rotation unit, which is rotatably held by the cartridge main body in a state that the photosensitive member is rotatably held, and which rotates up to a position where the photosensitive member can be detached.

This configuration makes it easy to set a photosensitive member to a detachable state, so that the replacement of photosensitive member can be easily executed.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

An image forming apparatus according to one embodiment of the present invention will be explained using the drawings attached hereto.

Figure 1:
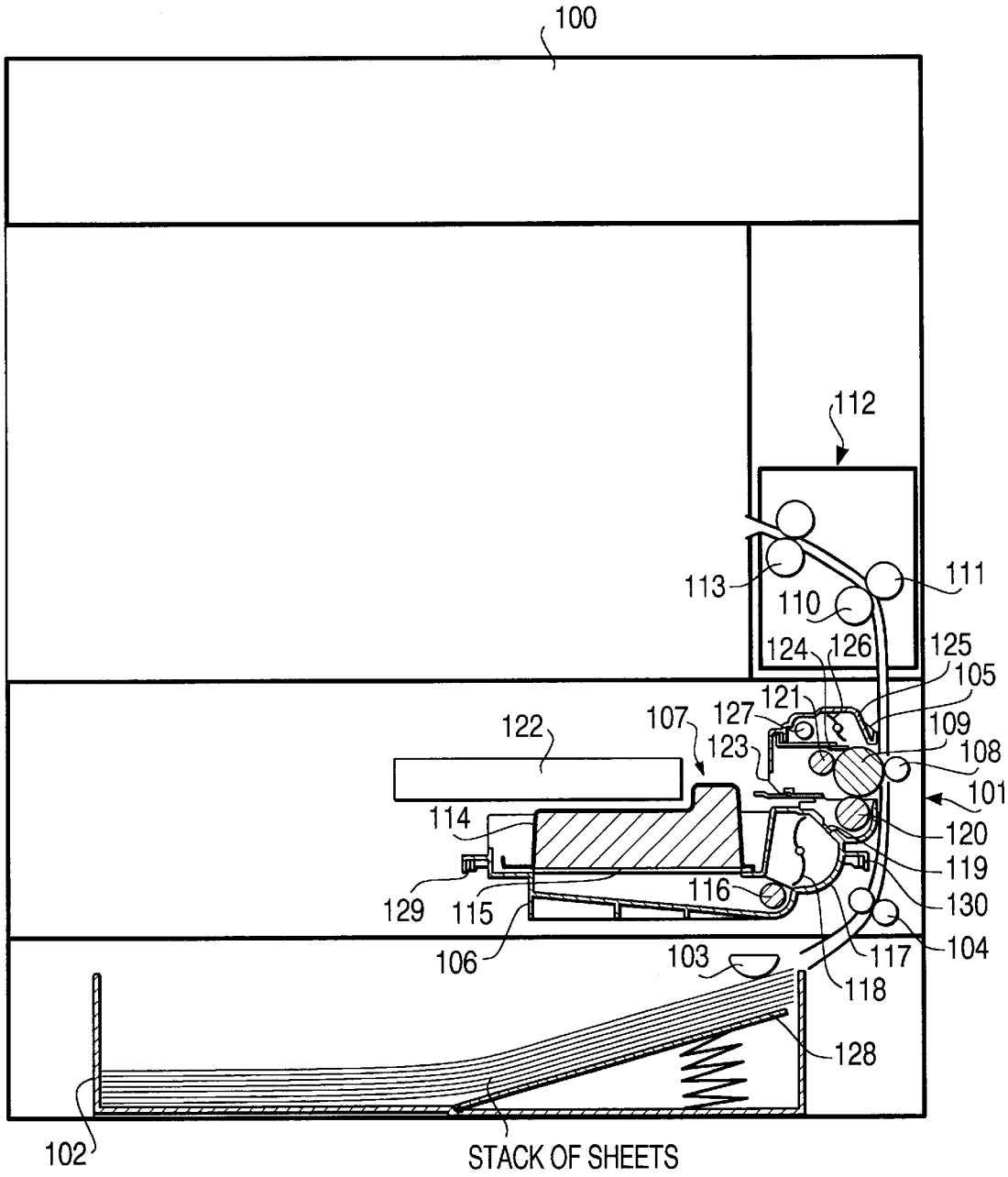
FIG. 1 is a sectional side elevation of an image forming apparatus according to one embodiment of the present invention.

First, a configuration of the image forming apparatus according to the above embodiment is explained using FIG. 1. FIG. 1 is a sectional side elevation of the image forming apparatus according to the above embodiment. This image forming apparatus records image data scanned by a scanner section 100, which is provided at the upper portion of the apparatus, or print data externally received on recording paper by use of an image recording section 101 to be described later.

A paper feed cassette 102 in which a batch of paper is held is detachably stored at the bottom of the main body of the apparatus. Recording papers held in the paper feed cassette 102 are pressed onto a paper feed roller 103 by a push-up plate 128, and carried to a transfer path by the paper feed roller 103. The paper feed roller 103 sends the recording papers carried from the paper feed cassette 102 up to a pair of resist rollers 104 provided at the transfer path. The resist rollers 104 execute timing control to align the record starting position of photosensitive member and the record starting position of recording papers.

While, at the central section of the image recording section 101, there is provided a storing section (not shown) for storing a toner cartridge 107, which comprises a cartridge main body 106 having a developing roller and a rotation unit 105. The rotation unit 105 is rotatably held about a waste toner cylinder 127, serving as a shaft, by the cartridge main body 106. The waste toner cylinder 127 has a photosensitive member and carries waste toner. Moreover, rails 129 and 130 are provided at both side portions of the toner cartridge 107, respectively. The rails 129 and 130 are fit into guide members (not shown) provided in the image forming apparatus, and slid in an internal direction of the image forming apparatus, making it possible to store the toner cartridge 107 at a predetermined position of the interior of the image forming apparatus. Here, the predetermined position is a position where a photosensitive roller 109, which is a photosensitive member for rotation unit 105, is held by the apparatus main body to come in contact with a transfer roller 108, which is fixed to the apparatus main body side. In this case, the cartridge main body 106 is held by the apparatus main body in a state that a magnet roller 120, which has a toner layer on its roller surface, is pressed against the photo sensitive roller 109.

The photosensitive roller 109 forms a latent image on its surface by being exposed from an optical unit 122, and forms a toner image on its surface according to the latent image. In addition, this embodiment gives an explanation using the photosensitive roller 109 as a photosensitive member, but a photosensitive member having no form of a roller may be used.

A voltage with polarity opposite to the toner image formed on the photosensitive roller 109 is applied to the transfer roller 108 and the transfer roller 108 presses recording paper to the photosensitive roller 109 in such a state, allowing the toner image formed on the photosensitive roller 109 to be transferred to the recording paper.

By the rotation of transfer roller 108, the recording paper to which the toner image is transferred is sent to a fixing unit 112 in which a fixing roller 110 and a pressing roller 111 are arranged to be opposite to each other. At the time when recording paper passes between the fixing roller 111 and fixing roller 110, recording paper is pressed by both rollers and heated by the fixing roller 110, whereby toner is fixed to the recording paper. The recording paper to which toner is fixed is discharged to a discharge paper receiving section via a discharging roller 113.

Next, an explanation of toner cartridge 107 will be given. Toner to be used in toner image that is formed on the photosensitive roller 109 is stored in a toner storing section 114, which is provided at the upper portion in the middle of the cartridge main body 106. In the toner storing section 114, magnetized toner is stored. Moreover, a film 115 is provided on the bottom of the toner storing section 114. By removing the film 115, toner is sent to a toner delivering roller 116, which is provided at the lower portion of the toner storing section 114.

Toner is adhered to the surface of toner delivering roller 116. By the rotation of toner delivering roller 116, adhered toner is sent to a toner supply section 117.

Furthermore, a toner sending member 118, which rotates about the substantially central portion of toner supply section 117, is provided at the interior of toner supply section 117. Since a film is attached to both end portions of the toner sending member 118, the toner sending member 118 can stir the entire toner of the toner supply section 117 and send it to an opening section 119.

A magnet roller 120 is provided at a position, which is close to the opening section 119 and which covers the opening section 119. The magnet roller 120 has a magnet in its interior. Since this magnetizes the magnet roller 120, and the rotation of magnet roller 120 makes it possible to form a toner layer, which is magnetized, on the curved surface extending in the vertical direction of the magnet roller 120.

Moreover, the photosensitive roller 109 is provided at a position close to the magnet roller 120. The photosensitive roller 109 rotates and its surface is charged by a charging roller 121, which is provided to come in contact with the photosensitive roller 109. The charging roller 121 rotates to follow the rotation of photosensitive roller 109. Next, the photosensitive roller 109 is exposed to light from the optical unit 122, which is provided at the left side of toner cartridge 107, through an opening section 123, which is provided at the side portion of the optical unit 122 of toner cartridge 107. This forms a latent image on the surface of the photosensitive roller 109. Then, the photosensitive roller 109 forms a toner image on its surface according to the latent image with toner supplied from the magnet roller 120.

Furthermore, at the portion directing to the rotational direction of photosensitive roller 109 rather than the position where the photosensitive roller 109 and transfer roller 108 come in contact with each other, a cleaning blade 124 is provided to come in partially contact with the photosensitive roller 109. The cleaning blade 124 scrapes toner, which is present on the surface of photosensitive roller 109 and which has not transferred to the recording paper, and send it to a waste toner storing section 125. Since this removes toner left on the surface of the photosensitive roller 109, the photosensitive roller 109 can form a desired latent image without fail next time, so that a desired toner image can be formed without fail.

At a portion, which is the interior of the waste toner storing section 125 and which is close to the cleaning blade 124, a waste toner sending member 126 is provided. The waste toner sending member 126 sends waste toner sent from the cleaning blade 124 to a waste toner cylinder 127, which is provided in the waste toner storing section 125. The waste toner cylinder 127 is cylindrically shaped, and waste toner is carried to its interior, and discharged to a waste toner collecting bottle (not shown). In this way, waste toner is discharged to the outside of the toner cartridge 107, and is collected.

Next, the toner cartridge according to the aforementioned embodiment will be explained.

By the rotation of rotation unit 105 with respect to the cartridge main body 106, the toner cartridge 107 of the present invention can rotate the photosensitive roller 109 from a state in which the photosensitive roller 109 is covered with the rotation unit 105 to a state in which it is not covered with the rotation unit 105, that is, the toner cartridge 107 can rotate the photosensitive roller 109 up to a detachable position. This makes it possible to attach and remove to/from the rotation unit 105 by operating the portion where the photosensitive roller 109 is attached to the rotation unit 105. In other words, even a general user can easily attach and remove to/from the rotation unit 105. As a result, even if the lifetime of the photosensitive roller 109 expires, only the photosensitive roller 109 can be replaced, and the other parts of toner cartridge 107 can be reused.

Figure 2:
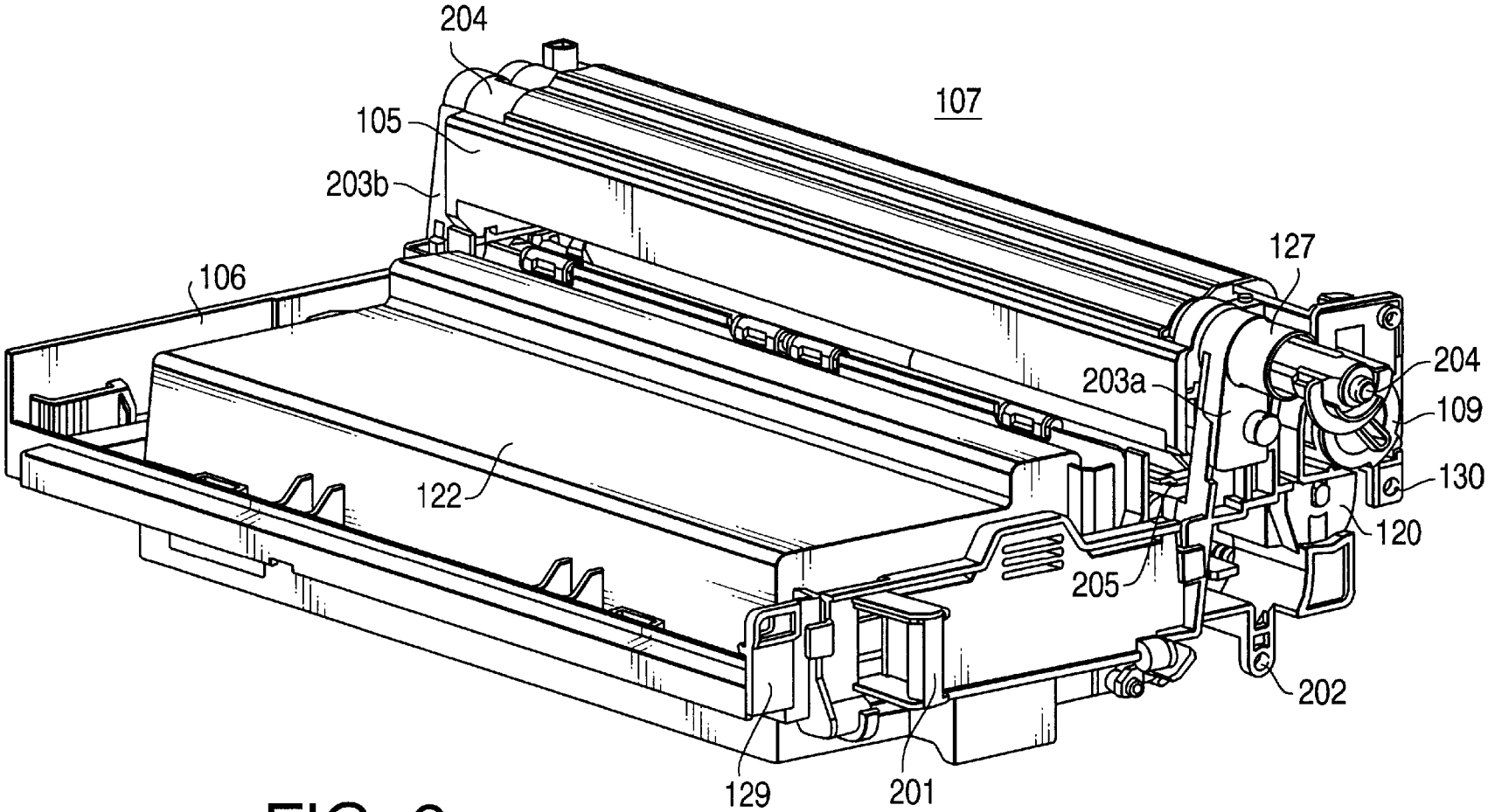
FIG. 2 is a perspective view of a cartridge according to the above embodiment.

The following will explain the configuration of the above-explained toner cartridge 107 using FIG. 2. FIG. 2 is a perspective view of a cartridge according to the above embodiment.

At the front side in the direction where the toner cartridge 107 is inserted, there is provided a knob portion 201, which a user picks up to attach the toner cartridge 107 to the image forming apparatus. The user picks up the knob portion 201 to fit the rails 129 and 130, which are provided at the both side portions in the inserting direction of toner cartridge 107, into guide member (not shown) of the image forming apparatus, and to slide the toner cartridge 107 in the inner direction of the image forming apparatus, thereby allowing the toner cartridge 107 to be easily attached to the image forming apparatus. Moreover, the user picks up the knob portion 201 to pull the toner cartridge 107, thereby detaching the toner cartridge 107 from the image forming apparatus easily.

Furthermore, at the bottom portion of the toner cartridge 107, there is provided a positioning member 202, which projects downwardly. This positioning member 202 is engaged with a positioning section (not shown) of the image forming apparatus, so that the toner cartridge 107 is positioned at a predetermined position of the image forming apparatus.

Moreover, in the vicinity of both ends of the longitudinal direction of the magnet roller 120 of the cartridge main body 106, there are formed a pair of support portions 203*a* and 203*b*, which project upwardly, that is, in the direction of the rotation unit 105. The waste cylinder 127 is rotatably held at a tip end of each of the support portions 203*a* and 203*b*. In the interior of the waste cylinder 127, a waste toner carrying screw 204 is rotatably held. By rotating the waste toner carrying screw 204, waste toner is carried in the longitudinal direction of the waste toner carrying screw 204.

Moreover, a cylindrical cavity (not shown) is formed at the side portion of the interior of the waste toner storing section 125 of the rotation unit 105, and the waste cylinder 127 is inserted into this cavity and is fixed. In other words, the rotation unit 105 is fixed by support portions 203*a* and 203*b* through the waste toner cylinder 127. Therefore, the rotation unit 105 rotates about the waste cylinder 127 serving as a rotating shaft.

The point to which attention should be paid is that the waste cylinder 127 doubles as a rotating shaft for the rotation unit 105. This eliminates the need for specially providing the rotating shaft for the rotation unit 105. As a result, the toner cartridge 107 can be miniaturized. The miniaturization of toner cartridge 107 allows the toner cartridge storing section of the imaging forming apparatus to be miniaturized, with the result that the size of the main body of the image forming apparatus can be also reduced.

Furthermore, in the vicinity of the position opposed to the rotation unit 105 of the cartridge main body 106, there is provided a release lever 205, which fixes the rotation unit 105 not to be rotated. The rotation unit 105 is normally fixed by this release lever 205. Moreover, in this state, since the photosensitive roller 109 is placed at a developing position, that is, a state that the photosensitive roller 109 abuts against the magnet roller 120 appropriately, the image forming operation can be correctly executed. Further, the release lever 205 is depressed downwardly, so that the rotation unit 105 can be released to be rotatable with respect to the cartridge main body 106.

Thus, the use of release lever 205 makes it possible to fix the photosensitive roller 109 to be correctly placed with respect to the rotation unit 105 and to set the rotation unit 105 to be a rotatable state from the fixed state easily.

Figure 3:
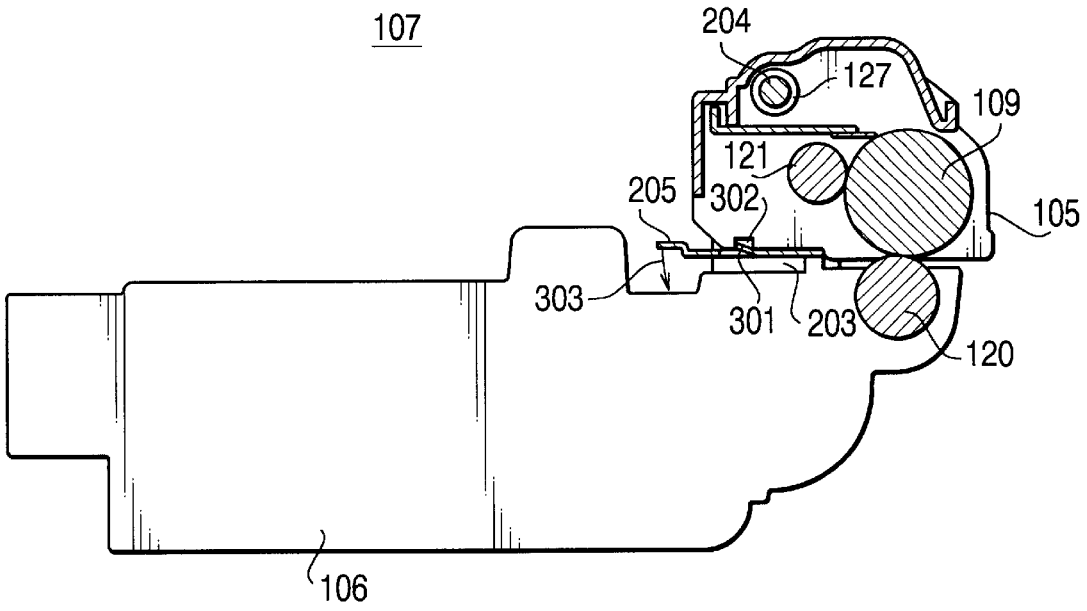
FIG. 3 is a schematic view showing the positional relationship between a rotation unit of the toner cartridge and a cartridge main body in a first state according to the above embodiment.
Figure 4:
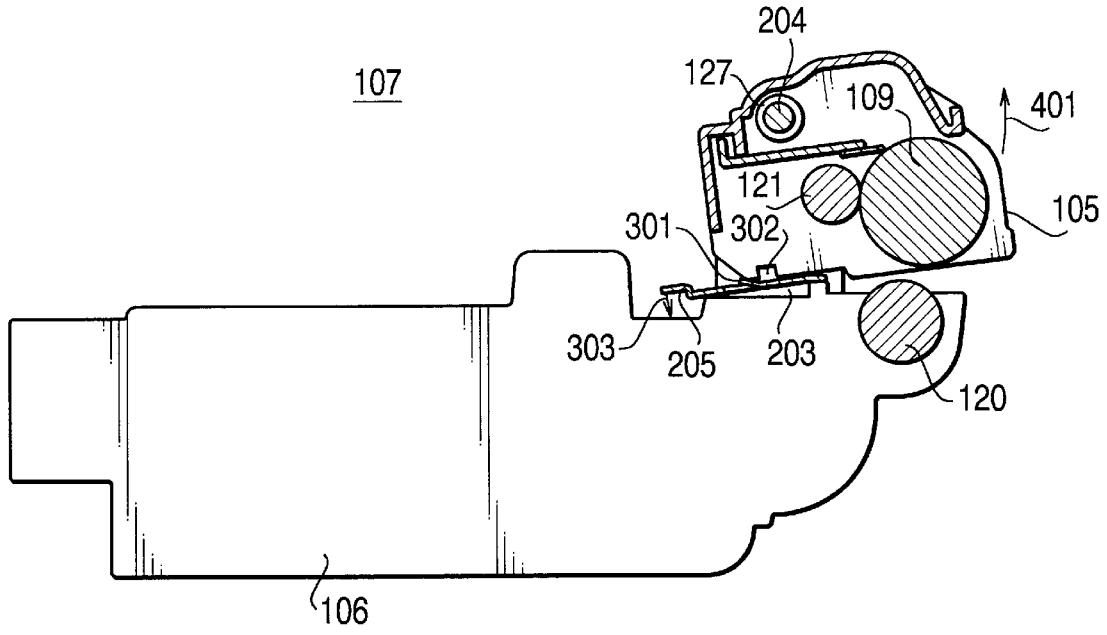
FIG. 4 is a schematic view showing the positional relationship between the rotation unit of the toner cartridge and the cartridge main body in a second state according to the above embodiment.
Figure 5:
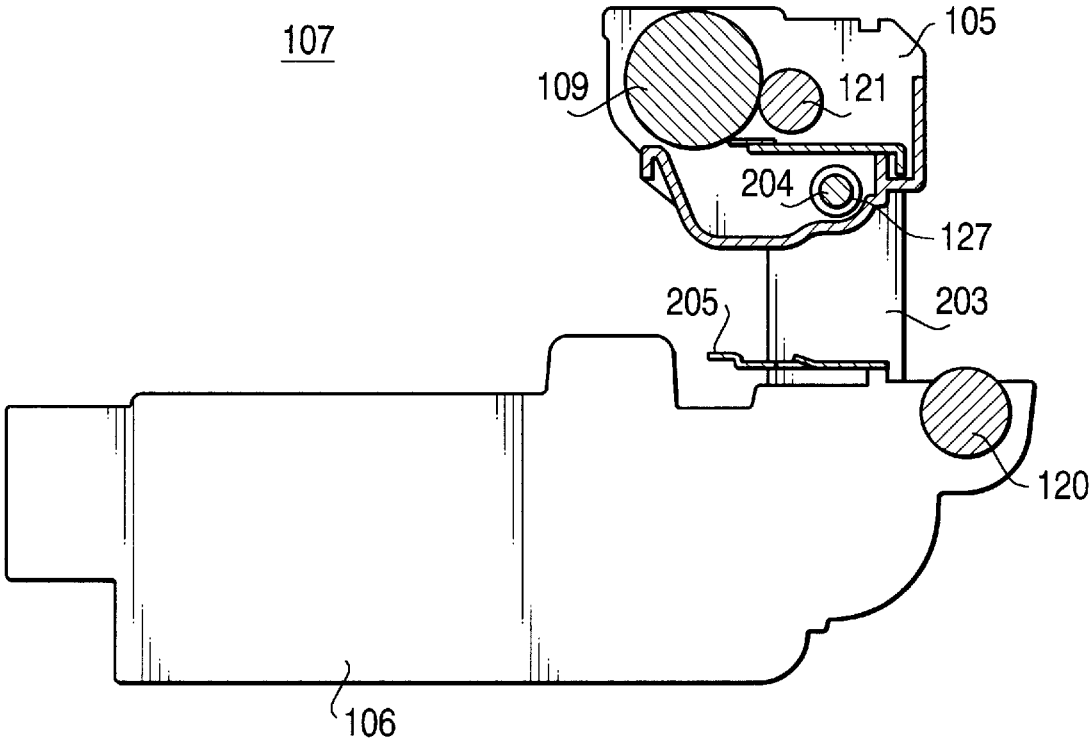
FIG. 5 is a schematic view showing the positional relationship between the rotation unit of the toner cartridge and the cartridge main body in a third state according to the above embodiment.
Figure 6:
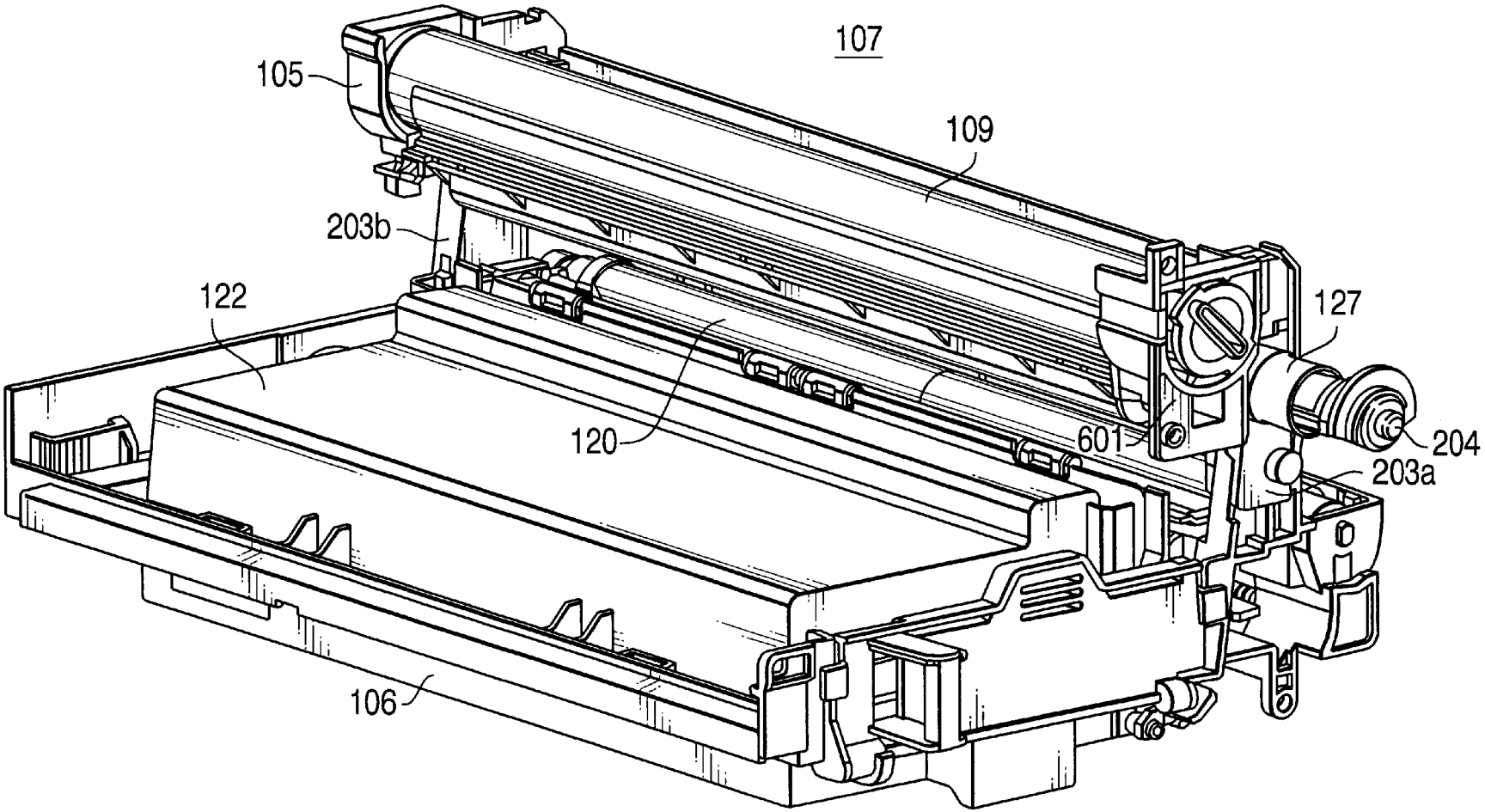
FIG. 6 is a perspective view of the toner cartridge in a state that the rotation unit is rotated according to the above embodiment.

With reference to FIGS. 3 to 6, the following will explain the operation in which the rotation unit 105 is rotated against the cartridge main body 106 such that the photosensitive roller 109 is changed from a state that it is covered with the rotation unit 105 to a state that it is not covered therewith, that is, from a state that the photosensitive roller 109 cannot be detached to a state that it can be detached. FIGS. 3 to 5 show schematic views showing the positional relationship between the rotation unit of the toner cartridge and the cartridge main body according to the above embodiment. FIG. 6 is a perspective view of the toner cartridge in a state that the rotation unit is rotated according to the above embodiment.

As is obvious from the figures, the tip end of the release lever 205 is fixed at a middle position where the rotation unit 105 and the cartridge main body 106 are opposed to each other. Then, the other end of the release lever 205 projects to the central direction of the cartridge main body 106 from the position where the rotation unit 105 and the cartridge main body 106 are opposed to each other.

Moreover, a projection 301, which projects upwardly, that is, in the direction of the rotation unit 105, is formed at the middle position of the release lever 205. On the other hand, a depression 302 is formed at a position opposite to the projection 301 of the release lever 205 of the rotation unit 105. The engagement of the projection 301 with the depression 302 makes it possible to fix the rotation unit 105 not to be rotated about the waste toner cylinder 127, which is attached to the support portions 203 and which serves as a rotating shaft. In other words, the rotating unit 105 is fixed to the cartridge main body 106. The state illustrated by FIG. 3 is a view showing this state. In the state as shown in FIG. 3, the photosensitive roller 109 is placed at the developing position, that is, the photosensitive roller 109 comes in contact with a predetermined position of the magnet roller 120 appropriately.

Further, the lower portion of the release lever 205 is an empty space other than the fixed portion, and one end of the release lever 205 moves downwardly (direction of an arrow 303). By pressing one end of the release lever 205 downwardly, it is possible to detach the projection 301 from the depression 302.

This releases the state in which the rotation unit 105 is fixed to the toner cartridge main body 106, so that the rotation unit 105 rotates about the waste toner cylinder 127, serving as a rotating shaft, anticlockwise, that is, in the direction of an arrow 401. Then, when the rotation unit 105 rotates, the rotation unit 105 moves in a direction away from the cartridge main body 106. In accordance with this movement, the photosensitive roller 109 and the magnet roller 120 are separated from each other. This is because the rotation unit 105 rotates about the waste cylinder 127, which is placed at the upper portion of the rotation unit 105, that is, a position away from the photosensitive member 109 with respect to the cartridge main body 106 and which serves as a rotating shaft, from the position closest to the cartridge main body 106. The state illustrated by FIG. 4 is a view showing this state.

If the rotation unit 105 further rotates in the direction of arrow 401 and is in a state that it is distant from the cartridge main body 106 most, the photosensitive roller 109 is in a state that it is not covered with the rotation unit 105. Namely, the photosensitive roller 109 is in a state that it is detachable from the rotation unit 105.

The states illustrated by FIGS. 5 and 6 are views showing the above state. Thus, the photosensitive roller 109 is in a state that it is not covered with the rotation unit, so that the photosensitive roller 109 is in a state that it is detachable from the rotation unit 105. In other words, the photosensitive roller 109 can be detached from the rotation unit 105 by only operating the member by which the photosensitive roller 109 is attached to the rotation unit 105.

In contrast to the above, according to the conventional apparatus, the photosensitive roller 109 is covered with a unit corresponding to the rotation unit 105. For this reason, the photosensitive roller 109 must be detached after the member covering the photosensitive roller 109 is detached. The work to detach the member covering the photosensitive roller 109 is not easily executed, and it is difficult for the general user to execute this work.

Moreover, in the state of FIG. 6, a projection member 601 comes in contact with the waste toner cylinder 127. The projection member 601 projects from the portion, which is close to the photosensitive roller 109 of the rotation unit 105, to the side, which is the direction where the rotation unit 5 rotates and which is the central direction of the toner cartridge main body 106. Further, the member, which is provided around the portion holding the photosensitive roller 109 of the rotation unit 105, comes in contact with the support portions 203*a* and 203*b*. The photosensitive roller 109 is shaped to be completely exposed upwardly in a state that the projection member 601 and the member, which is provided around the portion holding the photosensitive roller 109 of the rotation unit 105, are in contact with the waste toner cylinder 127 and the support portions 203*a* and 203*b*, respectively.

Thus, the photosensitive roller 109 is held in a state that it is completely exposed upwardly. This makes it possible for the user to easily execute the replacement of photosensitive member 109 in a state that the rotation unit 105 is completed rotated.

Moreover, the photosensitive roller 109 is in a state that it is not covered with the rotation unit 105, and the magnet roller 120 and charging roller 121 are also in a state that they are not covered with the rotation unit 105. Whereby, it is possible to easily execute the work to attach/detach the magnet roller 120 to/from the cartridge main body 106 and the work to attach/detach the charging roller 121 to/from the rotation unit 105.

Furthermore, the magnet roller 120 serves the function of preventing toner from being dropped from the cartridge main body 106 when the rotation unit 105 rotates against the cartridge main body 106. This makes it possible for the operator to execute the replacement of photosensitive roller 109 and the like without making hands dirty.

Here, the point to which attention should be paid is that the rotation unit 105 does not extend to the second cartridge main body 106 and the photosensitive roller 109 is positioned in the central direction of the cartridge main body 106. This is because the waste toner cylinder 127, serving as the rotating shaft, is placed in the central direction of the cartridge main body 106 rather than the photosensitive roller 109 while the rotation unit 105 is abutting against the cartridge main body 106. Then, the rotation unit 105 rotates about the waste toner cylinder, serving as the rotating shaft, from this state.

Thus, in a state in which the photosensitive roller 109 is not covered with the rotation unit 105, that is, the photosensitive roller 109 can be detached from the rotation unit 105, the photosensitive roller 109 is placed at the substantially central position without extending to the cartridge main body 106, so that the operator's working area may be small. Therefore, the operator can attach/detach the photosensitive roller 109 to/from the rotation unit 105 with the small area.

Figure 7:
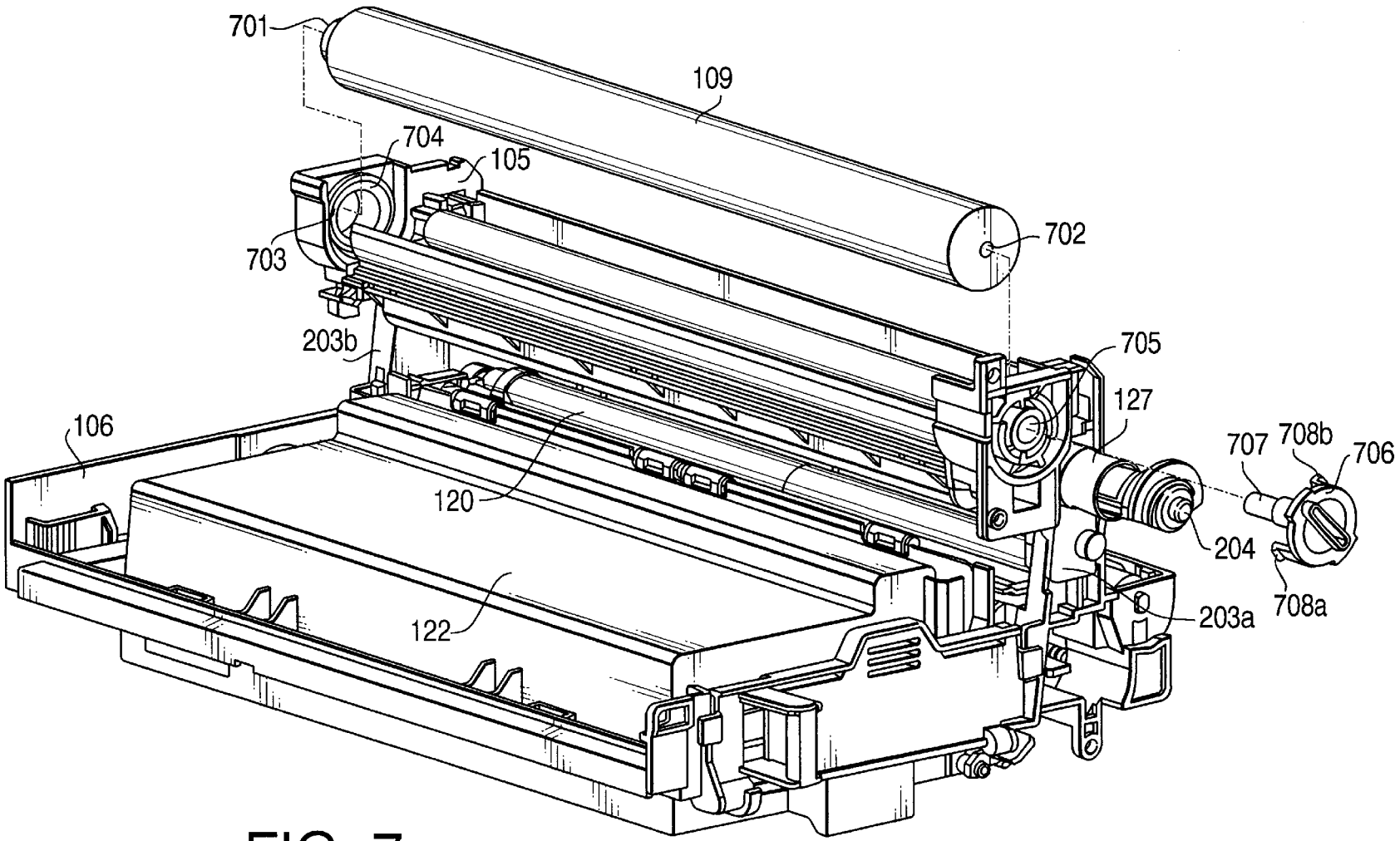
FIG. 7 is an exploded perspective view of the toner cartridge according to the above embodiment.

In addition, the aforementioned embodiment is configured such that the photosensitive roller 109 can be easily attached to the rotation unit 105. With reference to FIG. 7, an explanation will be given of the contrived configuration in which the photosensitive roller is attached to the rotation unit. FIG. 7 is an exploded perspective view of the toner cartridge according to the above embodiment.

As is obvious from the figure, a cylindrical projection 701, which projects in the direction of the rotating shaft, is formed at one end of the photosensitive roller 109. Moreover, a depression 702, which is cylindrically depressed in the direction of the rotating shaft, is formed at the other end of the photosensitive roller 109.

On the other hand, at the position, which is opposite to the projection 701 of the photosensitive roller 109 of the rotation unit 105, there is formed a hole 703 with a diameter, which is a little larger than that of the projection 701. Furthermore, at the inner side of the hole 703 of the rotation unit 105, there is formed a concave portion 704, which is shaped to correspond to the tip portion where the projection 701 is formed. In addition, at the position, which is opposite to the depression 702 of the photosensitive roller 109 of the rotation unit 105, there is formed a hole 705 with a diameter, which is a little larger than that of the depression 702.

Moreover, in the rotation unit 105, there is formed a bearing cap 706 for engaging the photosensitive roller 109 with the rotation unit 105. The bearing cap 706 has a disk shape in its one end. At the center of the disk shape of the bearing cap 706, there is formed a cylindrical projection 707 with a diameter, which is slightly smaller than that of the hole 705. At the outside of the disk portion of the bearing cap 706, there are formed engaging members 708*a* and 708*b*, which project in the same direction as that of the projection 707 and which have top ends projecting in the direction intersecting at the longitudinal direction.

Next, an explanation will be given of an operation for attaching the photosensitive roller 109 to the rotation unit 105.

First, the projection 701 of the photosensitive roller 109 is inserted to the hole of the rotation unit 105. In this state, the tip of the photosensitive roller 109 comes in contact with the concave portion 704 smoothly, so that the photosensitive roller 109 is maintained to be rotated smoothly. Then, in this state, the depression 702 of the photosensitive roller 109 and the hole 705 of the rotation unit 105 are positioned.

Next, the projection 707 of the bearing cap 706 is fit into the hole 705 from the side of the rotation unit 105. Moreover, at the surrounding portion of the hole 705, there are formed a portion with which engaging members 708*a* and 708*b* make contact and a portion with which they are not make contact. The bearing cap 706 is positioned such that the engaging members 708*a* and 708*b* do not make contact with the surrounding portion of the hole 705, and the bearing cap 706 is inserted into the hole 705. Then, the bearing cap 706 rotates about the projection 707, serving as a shaft, at about 45 degrees. Thereby, the engaging members 708*a* and 708*b* are hooked on the inner side of the hole 705, that is, the photosensitive roller 109 side of the hole 705. This prevents the bearing cap 706 from being pulled out of the hole 705.

Thus, since the photosensitive roller 109 of the above embodiment is not fastened to the unit with screws unlike the conventional photosensitive roller, the attachment/detachment of the photosensitive roller 109 to/from the rotation unit 105 can be easily performed.

As explained above, according to the above-mentioned embodiment, the rotation of the rotation unit 105 to the cartridge main body 106 makes it easily to set the photosensitive roller 109 to be in a state that it is easily detached from the rotation unit 105. This allows the photosensitive roller 109 to be easily detached from the rotation unit 105. Therefore, only the photosensitive roller 109 can be easily replaced without replacing the entire the toner cartridge 107 when the need for replacing the photosensitive roller 109 arises. As a result, an economical burden on the user can be reduced.

In addition, though the above embodiment explains a case in which the present invention is applied to the image forming apparatus having the toner cartridge 107, the present invention may be applied to the other apparatus excepting the image forming apparatus, for example, a facsimile apparatus comprising transmission and reception means for transmitting and receiving data from/to other communication terminals if the apparatus has the form with the toner cartridge 107.

In addition, the way to divide the toner cartridge 107 may be in the form that the magnet roller 120 is provided at the side of the rotation unit excepting the way to divide the rotation unit 105 and the cartridge main body 106.

As explained above, according to the present invention, since the rotation of the rotation unit allows the photosensitive member to be rotated to the detachable position, the photosensitive member can be easily detached. This makes it possible to reduce the economical burden on the user.

The present invention is not limited to the above-described embodiments, and various variations and modifications may be possible without departing from the scope of the invention.

This application is based on the Japanese Patent Application No. 2000-056276 filed on Mar. 1, 2000, entire content of which is expressly incorporated by reference herein.

What is claimed is:

1. A toner cartridge with a detachable photosensitive member comprising:

a cartridge main body having a toner storing section that stores toner;

a photosensitive member that forms a toner image using the toner; and a rotation unit, which is rotatably supported by the cartridge main body in a state that the photosensitive member is rotatably maintained, and that rotates the photosensitive member to a detachable position, wherein a rotating shaft of the rotating unit is provided at a central side of the cartridge main body, and the rotation unit moves in the central direction of the cartridge main body when rotating about the rotating shaft.

2. The toner cartridge according to claim 1, further comprising a charging roller provided in the rotation unit and configured to come into contact with the photosensitive member.

3. The toner cartridge according to claim 2, wherein the rotation of the rotation unit allows the photosensitive member to be set to a state in which the photosensitive member is not covered with the rotation unit, and the charging roller to be set to a state in which the charging roller is not covered with the rotation unit.

4. The toner cartridge according to claim 1, further comprising a magnet roller that supplies toner of the toner storing section to the photosensitive member.

5. The toner cartridge according to claim 4, wherein the rotation of the rotation unit allows the photosensitive member to be set to a state in which the photosensitive member is not covered with the rotation unit, and the magnet roller to be set to a state in which the magnet roller is not covered with the rotation unit.

6. The toner cartridge according to claim 1, further comprising a waste toner cylinder that carries waste toner, wherein the waste toner cylinder comprises the rotating shaft of the rotation unit.

7. The toner cartridge according to claim 1, wherein the rotation of the rotation unit allows the photosensitive member to be set to a state in which the photosensitive member is not covered with the rotation unit.

8. An image forming apparatus comprising:

an image recording section including a toner cartridge according to claim 1;

a paper feed section that feeds recording paper to the image recording section; and a discharge section that discharges the recording paper recorded by the image recording section.

9. The image forming apparatus according to claim 8, further comprises a positioning member that positions the toner cartridge with respect to the image recording apparatus.

10. The image forming apparatus according to claim 8, wherein the toner cartridge comprises a knob portion, which is used when the toner cartridge is attached to the image recording section, at the front side in a direction in which the toner cartridge is inserted into the image recording section.

11. A toner cartridge with a detachable photosensitive member comprising:

a cartridge main body having a toner storing section that stores toner;

a photosensitive member that forms a toner image using the toner;

a rotation unit, which is rotatably supported by the cartridge main body in a state that the photosensitive member is rotatably maintained, and that rotates the photosensitive member to a detachable position; and a release mechanism that releases the rotation unit from a state in which the photosensitive member is fixed in a developing position to a state in which the photosensitive member is rotatable.

12. The toner cartridge according to claim 11, further comprising a magnet roller that supplies toner of the toner storing section to the photosensitive member, wherein the rotation unit is fixed in the developing position by the release lever, whereby the photosensitive member is set to a state abutting against the magnet roller.

* * * * *

UNITED STATES PATENT AND TRADEMARK OFFICE

CERTIFICATE OF CORRECTION

PATENT NO. : 6,347,204 B1
DATED : February 12, 2002
INVENTOR(S) : E. Kurosawa

It is certified that error appears in the above-identified patent and that said Letters Patent is hereby corrected as shown below:

Title page,
Item [30], Foreign Application Priority Data, "12-056276" should be -- 2000-056276 --.

Signed and Sealed this

Fifteenth Day of October, 2002

*Attest:*

*Attesting Officer*

JAMES E. ROGAN
*Director of the United States Patent and Trademark Office*